US010526762B2

(12) United States Patent
Lin et al.

(10) Patent No.: US 10,526,762 B2
(45) Date of Patent: Jan. 7, 2020

(54) FINAL JOINT OF IMMERSED TUNNEL AS WELL AS PREFABRICATION METHOD AND INSTALLATION METHOD

(71) Applicants: China Communications Construction Company Limited, Beijing (CN); CCCC Highway Consultants Co. Ltd., Beijing (CN)

(72) Inventors: Ming Lin, Beijing (CN); Xiaodong Liu, Beijing (CN); Jibing Gao, Beijing (CN); Yi Li, Beijing (CN); Haiqing Yin, Beijing (CN); Wei Lin, Beijing (CN); Yonggang LV, Beijing (CN); Ke Deng, Beijing (CN); Qiang Wang, Beijing (CN); Qian Cheng, Beijing (CN); Lingfeng Liu, Beijing (CN); Hai Ji, Beijing (CN); Zhigang Zhang, Beijing (CN); Huaiping Su, Beijing (CN); Xiaodong Wang, Beijing (CN)

(73) Assignees: China Communications Construction Company Limited, Beijing (CN); CCCC Highway Consultants Co. Ltd., Beijing (CN)

( * ) Notice: Subject to any disclaimer, the term of this patent is extended or adjusted under 35 U.S.C. 154(b) by 0 days.

(21) Appl. No.: 15/870,522

(22) Filed: Jan. 12, 2018

(65) Prior Publication Data

US 2018/0274197 A1 Sep. 27, 2018

(30) Foreign Application Priority Data

Mar. 24, 2017 (CN) ..... 2017 1 01827354

(51) Int. Cl.

| | |
|---|---|
| ***E02D 29/073*** | (2006.01) |
| ***E02D 29/16*** | (2006.01) |
| ***E02D 29/067*** | (2006.01) |
| ***E02D 29/07*** | (2006.01) |

(52) U.S. Cl.

CPC ..... *E02D 29/073* (2013.01); *E02D 29/067* (2013.01); *E02D 29/07* (2013.01); *E02D 29/16* (2013.01); *E02D 2250/0061* (2013.01)

(58) Field of Classification Search

CPC ..... E02D 29/063; E02D 29/067; E02D 29/07; E02D 29/073; E02D 29/077

(Continued)

(56) References Cited

U.S. PATENT DOCUMENTS 3,695,044 A * 10/1972 Hoshino ..... E21D 5/012 277/654
3,750,411 A * 8/1973 Shimizu ..... E02D 25/00 277/608

(Continued)

FOREIGN PATENT DOCUMENTS

CH 706442 * 10/2013
DE 1209514 B * 1/1966 ..... E02D 29/08

(Continued)

*Primary Examiner* — Frederick L Lagman
(74) *Attorney, Agent, or Firm* — Andrew D. Fortney; Central California IP Group, P.C.

(57) ABSTRACT

The present application discloses a final joint of an immersed tunnel, a prefabrication method and an installation method, wherein the final joint includes two end surfaces connected with installed adjacent tube sections; the two end surfaces are both tilted surfaces, so that the longitudinal profile of the final joint along an installation direction is of an inverted trapezoid structure; and the final joint further may be of a structure with a tube section I and a tube section II which are connected with each other. The final joint of the immersed tunnel is simple in structure, convenient to control and relatively high in precision, thereby reducing lots of open sea diving work and lowering a risk of installation quality defects; as prefabrication procedures are simple, the final joint may be prefabricated in a land factory and then transported to the site, thereby reducing influence of weather (Continued)

conditions on construction; a body structure of the final joint is prefabricated in the factory, and then the overall final joint is transported to the site for installation; water stop systems realize quick water stop, thus forming a dry construction environment; and therefore, the influence of weather and tidal current conditions on a project may be reduced, and a quality risk may be lowered.

26 Claims, 4 Drawing Sheets

(58) Field of Classification Search
USPC ..... 405/136, 137
See application file for complete search history.

(56) References Cited

U.S. PATENT DOCUMENTS 5,322,390 A * 6/1994 Niimura ..... E02D 29/063 405/134
5,346,332 A * 9/1994 Wagner ..... E21D 11/083 405/135
8,191,580 B2 * 6/2012 Scott ..... F16L 9/22 138/120

FOREIGN PATENT DOCUMENTS

GB 752306 A * 7/1956 ..... E02D 29/073
WO WO-9006401 A1 * 6/1990 ..... E02D 29/08

* cited by examiner

FINAL JOINT OF IMMERSED TUNNEL AS WELL AS PREFABRICATION METHOD AND INSTALLATION METHOD

This application claims the benefit of Chinese Patent Application No. 2017101827354, filed Mar. 24, 2017, incorporated herein by reference in its entirety.

TECHNICAL FIELD

The present application relates to the technical field of immersed tunnels, and more particularly relates to a final joint of an immersed tunnel, a prefabrication method of the final joint of the immersed tunnel, and an installation method of the final joint of the immersed tunnel.

BACKGROUND ART

Immersed tube method-based tunnel construction is to respectively transport tunnel caissons, which are prefabricated in a semi-submerged barge or a dry dock, in a floating manner to preset positions for immersion and jointing. In order to successfully immerse the last tube section, a distance space longer than the tube section must be reserved, and the tube section immersed and jointed in the reserved distance space is regarded as a final joint. The final joint of the immersed tunnel is crucial for construction of the immersed tunnel, particularly for construction of an open sea ultra-long immersed tunnel under severe site construction conditions, and complicated ocean environmental conditions and weather conditions such as waves and ocean current.

At the present, constructed large-sized undersea immersed tunnels are mainly distributed in America, Europe and Japan. China has built several immersed tunnels, but has not yet built large-sized undersea immersed tunnel. Moreover, the domestic deep-sea or cross-sea immersed tunnels are planned or under construction. It is a severe challenge for construction of the final joint of the immersed tunnel because of different geographical environments, hydrology-weather conditions, construction technologies and construction period requirements.

General schemes for final joints of open sea large-sized immersed tunnels in the world mainly include: conventional weir enclosing method and water stop plate method, and modern end portion block method, V-shaped block method and KEY tube section method, wherein the weir enclosing method and the end block method are applicable to a situation that the final joint is placed at a shoreside hidden section; the V-shaped block method has high requirements for measurement precision and jointing deviation; in the KEY tube section method, it is required that a tube section is generally 100 m in length, and if the tube section is too long, its installation and control would hardly meet a precision requirement of the construction method; and in the water stop plate method, underwater work is mainly completed by diving, and the construction period for river immersion is generally 3 to 4 months. For the open sea large-sized immersed tunnels, diving work is limited by weather and wave current conditions of the open sea; and in addition, due to the mutual effect of uncertainty of the open sea site working time and a back-silting environment, the construction period and the quality of a project and a project risk are hard to control.

Therefore, in view of the above problems, the present application is in urgent need of a novel scheme for the final joint of the immersed tunnel, which may make the installation construction of the final joint faster and safer in a project with a construction site far away from the land, difficult open sea working conditions and a relatively high requirement for the construction period, thereby shortening the project construction period and lowering the quality risk

SUMMARY OF THE INVENTION

For the purpose of overcoming the shortcomings of an existing construction method for a final joint of an immersed tunnel in the prior art such as inconvenience in control, low precision and long project construction period, the present application provides a final joint of an immersed tunnel and a prefabrication method of the final joint of the immersed tunnel, and further provides an installation method of the final joint of the immersed tunnel.

In order to achieve the above-mentioned purpose, the present application provides a technical scheme as follows:

A final joint of an immersed tunnel is provided, including two end surfaces connected with installed adjacent tube sections. The two end surfaces are both tilted surfaces, so that the longitudinal profile of the final joint along an installation direction is of an inverted trapezoid structure.

According to the final joint of the immersed tunnel of the present application, the two end surfaces of the final joint are set as the tilted surfaces, so that the whole final joint is of the inverted trapezoid structure; and therefore, during immersed installation of a final tube head, its position and posture may be controlled conveniently, a risk of collision with the to-be-connected installed adjacent tube sections is lowered, and the final tube head enters an installation station conveniently. The tilted surfaces formed by the final joint may be connected with the installed adjacent tube sections in a matched manner to realize final installation construction. The final joint of the immersed tunnel is simple in structure, convenient to install and control and relatively high in precision. During installation, lots of open sea diving work may be further reduced, and a risk of installation quality defects is lowered.

It should be noted that formation of the inverted trapezoid structure by the final joint means that the inverted trapezoid structure having an upper bottom longer than a lower bottom is formed on a profile of the final joint along the longitudinal direction of the installed adjacent tube sections, and in that way, two connection surfaces of the final joint are in a tilting direction, and two end surfaces of the installed adjacent tube sections matched with the two connection surfaces of the final joint are slantways upward, thereby facilitating jointing of the final joint and the installed adjacent tube sections.

Preferably, the final joint includes a tube section I and a tube section II which are connected with each other. The connection surfaces, which are respectively connected with the installed adjacent tube sections, of the tube section I and the tube section II are tilted surfaces, so that the longitudinal profile jointly formed by the tube section I and the tube section II along an installation direction is of the inverted trapezoid structure.

The final joint may further adopt the tube section I and the tube section II to form the inverted trapezoid structure, so that during immersed installation of the final tube head, its position and posture may be controlled conveniently, the risk of collision with the to-be-connected installed adjacent tube sections is lowered, and the final tube head enters the installation station conveniently. The tilted surfaces formed by the tube section I and the tube section II are matched with the installed adjacent tube sections, and then connection and installation construction are completed. The final joint formed by connecting the two tube sections is convenient to machine, and in addition, a space between tube sections is also formed after subsequent assembly of the two tube sections, thereby facilitating subsequent installation construction of seal doors.

Preferably, the tube section I and the tube section II are connected through water stop structural members and a plurality of shear keys. The water stop structural members are disposed at the peripheries of combination surfaces of the tube section I and the tube section II to enhance the connection strength of the tube section I and the tube section II.

Further preferably, the shear keys include middle wall vertical steel shear keys disposed at the middle part of the combination surface of the tube section I or the tube section II and side wall vertical steel shear keys disposed on two sides of the combination surfaces, and horizontal shear keys connected between the inner walls of the tube section I and the tube section II.

The shear keys are disposed between the tube section I and the tube section II, wherein the middle wall vertical steel shear keys and the side wall vertical steel shear keys are disposed on the combination surfaces of the tube section I and the tube section II; the middle wall vertical steel shear keys are located at middle part isolation wall body positions of the combination surfaces of the tube section I and the tube section II; the side wall vertical steel shear keys are located at side wall isolation wall body positions on two sides of the combination surfaces of the tube section I and the tube section II; for all the middle wall vertical steel shear keys and all the side wall vertical steel shear keys, one part of each structure is located in a corresponding groove position on the combination surface of the tube section I, and the other part of the structure is located in a corresponding groove position on the combination surface of the tube section II; more than one middle wall vertical steel shear key and more than one side wall vertical steel shear key are included; in addition, for the horizontal shear keys, one part of each structure is connected to the inner wall of a channel of the tube section I, and the other part of the structure is connected to the inner wall of a channel of the tube section II; and the quantity of the horizontal shear keys is equal to that of the mutually corresponding channels in the tube section I and the tube section II. The middle wall vertical steel shear keys and the side wall vertical steel shear keys have effects of preventing the combination surfaces of the tube section I and the tube section II from mutually sliding and moving up and down, and the horizontal shear keys have an effect of preventing mutual longitudinal separation of the tube section I and the tube section II.

Preferably, the tube section I and the tube section II are of the same structures, and their longitudinal profiles are both of right trapezoid structures which are convenient to machine and prefabricate, thereby the profile of the final joint formed by jointing the tube section I with the tube section II is of an isosceles trapezoid structure.

Further preferably, an inclination angle formed between the tilted end surface of the tube section I or/and the tube section II and the vertical direction is 5 to 15 degrees, and correspondingly, an inclination angle formed between the connection surface of the installed adjacent tube sections which is matched with the tilted end surface, and the vertical direction is also 5 to 15 degrees.

Preferably, water stop systems are disposed on the two end surfaces, which are connected with the installed adjacent tube sections, of the final joint.

Preferably, water stop systems for connecting the installed adjacent tube sections are arranged on the connection surfaces of the tube section I and the tube section II. The water stop systems include push devices disposed on the connection surface of the tube section I or/and the tube section II; a circle of water stop band is arranged outside each push device; and the water stop band is preferably a Gina water stop band, thereby achieving a better water stop effect.

The push devices are used for enabling the Gina water stop bands to be in contact with the surfaces of the installed adjacent tube sections to realize water stop between combination cavities and the outside after the Gina water stop bands are fully compressed during connection of the tube section I as well as the tube section II and the corresponding installed adjacent tube sections, thereby facilitating the later water drainage of the combination cavities and forming a dry construction environment.

Further preferably, the push devices include jacks disposed on the connection surfaces of the tube section I and the tube section II. Piston rods of the jacks are connected with pushing joists which are respectively connected to the connection surfaces of the tube section I and the tube section II through joist sliding blocks.

Further preferably, a plurality of cavities are formed in the peripheries of the tube section I and the tube section II. Each jack and each pushing joist are disposed in each cavity.

Further preferably, the end portion of each pushing joist is parallel to the connection surfaces of the tube section I and the tube section II, and the Gina water stop bands are perpendicularly disposed on the end surfaces of the pushing joists.

Further preferably, M-shaped water stop bands are further disposed between the pushing joists and the tube sections I and II. Made of butadiene styrene rubber, the M-shaped water stop bands may have certain deformability under a condition of a pressure greater than a specific water pressure.

Further preferably, the M-shaped water stop bands are fixedly connected to the pushing joists through pressing member systems including pressing plates, pressing strips, screws and spring washers which are connected with the two end portions of the M-shaped water stop bands.

Preferably, the tube section I and the tube section II are longitudinally equipped with at least two backup pipelines penetrating through the two tube sections. The backup pipelines are equipped with prestressed tendons for realizing tighter fitting between the combination surfaces of the tube section I and the tube section II, thereby the two tube sections are mutually compressed under the action of the prestressed tendons to be fixed more firmly.

Further preferably, two backup pipelines penetrating through the two tube sections are disposed at each of the top and the bottom of each of the tube section I and the tube section II. Prestressed tendons are disposed in each backup pipeline, and anchor heads are disposed at the end portions of the backup pipeline.

Preferably, the tube section I and the tube section II are both of hollow structures, and end seal doors are disposed in their inner cavities to prevent the water from entering the tube section I and the tube section II during tube immersion and avoid the influence on subsequent connection construction.

Preferably, the tube section I or/and the tube section II includes a metal shell body. A plurality of transverse diaphragms and longitudinal diaphragms are disposed in the shell body; all the transverse diaphragms and longitudinal diaphragms divide the shell body of the tube section I or/and the tube section II into a plurality of closed compartments;

and each compartment is filled with concrete, and has concrete pouring holes and exhaust holes.

The tube section I or/and the tube section II adopts a steel shell body, and the transverse diaphragms and the longitudinal diaphragms which are disposed in the shell body divide the interior of the steel shell body into a plurality of compartments of independent cavities; the compartment of each cavity is sealed after being poured with concrete, thereby forming a shell body concrete composite structure which may meet the requirement for the rigid connection strength of the tube section I or/and the tube section II and the installed adjacent tube sections.

Further preferably, a plurality of L-shaped steel stiffening ribs are disposed on the connection surface of the tube section I or/and the tube section II.

A plurality of L-shaped steel stiffening ribs are disposed on the connection surface of the tube section I or/and the tube section II, and the shear force transmission L-shaped steel stiffening ribs are distributed according to certain spacing, and transverse stiffening plates are also disposed longitudinally at certain spacing, thereby preventing slippage between steel plates and a concrete interface to guarantee common deformations of the shell bodies and the filled concrete.

The present application further provides a prefabrication method of a final joint of an immersed tunnel, including:

Step I, forming a shell body of the final joint according to a to-be-fabricated shape of the final joint;

Step II, installing a plurality of transverse diaphragms and longitudinal diaphragms in the shell body of the final joint, thus forming a plurality of compartments, and forming pouring holes and exhaust holes in each compartment;

Step III, arranging prestressed tendons in the shell body of the final joint in a penetrating manner, and tensioning the shell body;

Step IV, performing pouring: pouring concrete respectively through the pouring holes in the shell body of the final joint, thus completing prefabrication of the final joint of the immersed tunnel.

According to the prefabrication method of the final joint of the immersed tunnel of the present application, prefabrication of a final structure of the immersed tunnel is realized by prefabricating the shell body of the final joint, arranging the plurality of transverse diaphragms and longitudinal diaphragms to form the plurality of compartments, then tensioning and compressing the final joint through the prestressed tendons, and finally pouring the concrete and installing water stop systems; prefabrication procedures of the final joint of the immersed tunnel are simple; and the final joint may be prefabricated in a land factory and then transported to the site, thereby reducing influence of weather conditions on construction, also lowering a quality risk, and improving the prefabrication efficiency of the final structure of the immersed tunnel.

Further preferably, when the final joint includes a tube section I and a tube section II, its prefabrication method includes:

Step I, respectively forming a shell body of the tube section I and a shell body of the tube section II according to shapes of the tube section I and the tube section II;

Step II, installing a plurality of transverse diaphragm and longitudinal diaphragms in the shell body of the tube section I and the shell body of the tube section II to form a plurality of compartments, and forming pouring holes and exhaust holes in each compartment;

Step III, connecting the shell body of the tube section I with the shell body of the tube section II, and performing tensioning and compression through prestressed tendons;

Step IV, performing pouring: respectively pouring concrete through the pouring holes in the shell body of the tube section I and the shell body of the tube section II, thus forming the tube section I and the tube section II;

Step V, installing water stop systems on the connection surfaces, which are respectively connected with installed adjacent tube sections, of the shell body of the tube section I and the tube section II, thus completing prefabrication of the final joint of the immersed tunnel.

According to the prefabrication method of the final joint of the immersed tunnel, prefabrication of a final structure of the immersed tunnel is realized by prefabricating the shell body of the tube section I and the shell body of the tube section II, arranging the plurality of transverse diaphragms and longitudinal diaphragms to form the plurality of compartments, then connecting the two tube sections, tensioning and compressing the tube sections through the prestressed tendons, and finally pouring the concrete and installing the water stop systems; prefabrication procedures of the final joint of the immersed tunnel are simple; and the final joint may be prefabricated in a land factory and then transported to the site, thereby reducing influence of weather conditions on construction, also lowering a quality risk, and improving the prefabrication efficiency of the final structure of the immersed tunnel.

Further preferably, the way of connecting the shell body of the tube section I with the shell body of the tube section II in Step III is realized through horizontal shear keys, middle wall vertical steel shear keys and side wall vertical steel shear keys which are disposed on the combination surface of the tube section I or the tube section II.

Further preferably, within 48 hours after the tensioning is carried out through the prestressed tendons in Step III, vacuum pressure grouting is carried out in a prestressed tendon pipeline, and two ends of the prestressed tendon pipeline are anchored at the same time.

In addition, the present application further provides an installation method of a final joint of an immersed tunnel, including:

Step I, prefabricating the final joint: forming the final joint of the immersed tunnel by adopting the above-mentioned prefabrication method of the final joint of the immersed tunnel;

Step II, arranging tilted to-be-installed surfaces at the end portions of two installed adjacent tube sections to be connected with the final joint, respectively matching the two to-be-installed surfaces with connection surfaces of the final joint, and respectively installing end seal doors at two ends of the final joint opposite to the two installed adjacent tube sections;

Step III, towing the final joint of the immersed tunnel to a position above an installation station, then immersing the final joint, and adjusting the posture of the final joint to enable the final joint to be aligned with the installation station between the two installed adjacent tube sections;

Step IV, respectively switching on water stop systems on the final joint, wherein the two water stop systems are respectively in contact with the to-be-installed surfaces of the two installed adjacent tube sections to respectively form two combination cavities;

Step V, draining water from each combination cavity, thus forming a dry working environment;

Step VI, temporarily locking the two connection surfaces of the final joint on the corresponding installed adjacent tube sections respectively, removing the end seal doors, and respectively welding the two ends of the final joint onto the corresponding installed adjacent tube sections;

Step VII, relieving prestress in the final joint, grouting a prestressed tendon pipeline, and finally completing installation of the final joint of the immersed tunnel.

According to the installation method of the final joint of the immersed tunnel, a body structure of the final joint is prefabricated in a factory, and the water stop systems are also installed in the factory; then the overall final joint is transported to the site for installation through a large-sized floating crane; and the water stop systems realize quick water stop to form the dry construction environment, thereby reducing influence of weather and tidal current conditions on a project, and also shortening the project construction period and lowering a quality risk.

Further, when the final joint includes a tube section I and a tube section II, its installation method includes:

Step I, prefabricating the tube section I and the tube section II, and forming the final joint of the immersed tunnel by adopting the above-mentioned prefabrication method of the final joint of the immersed tunnel;

Step II, arranging tilted to-be-installed surfaces on two installed adjacent tube sections to be connected with the tube section I and the tube section II, respectively matching the two to-be-installed surfaces with connection surfaces of the tube section I and the tube section II in shape, and respectively installing end seal doors in the tube section I, the tube section II and the two installed adjacent tube sections;

Step III, towing the final joint of the immersed tunnel to a position above an installation station, then immersing the final joint, and adjusting the posture of the final joint to enable the final joint to be aligned with the installation station between the two installed adjacent tube sections;

Step IV, respectively switching on water stop systems on the tube section I and the tube section II, wherein the two water stop systems are respectively in contact with the to-be-installed surfaces of the two installed adjacent tube sections to respectively form two combination cavities;

Step V, draining water from each combination cavity, thus forming a dry working environment;

Step VI, temporarily locking the tube section I and the tube section II on the corresponding installed adjacent tube sections respectively, removing the end seal doors, and respectively welding the connection surfaces of the tube section I and the tube section II onto the corresponding installed adjacent tube sections;

Step VII, relieving prestress in the tube section I and the tube section II, grouting a prestressed tendon pipeline, and finally completing installation of the final joint of the immersed tunnel.

According to the installation method of the final joint of the immersed tunnel, the tube section I and the tube section II are prefabricated in a factory, and then a body structure of the final joint is formed, wherein the water stop systems are also installed in the factory; then the overall final joint is transported to the site for installation through a large-sized floating crane; and the water stop systems realize quick water stop to form the dry construction environment, thereby reducing influence of weather and tidal current conditions on a project, and also shortening the project construction period and lowering a quality risk.

Further preferably, the end seal doors are disposed in the two installed adjacent tube sections in Step II, and then are removed after Step V is completed.

Further preferably, before the final joint of the immersed tunnel is immersed in Step III, a gravel foundation bed is pre-paved on a bottom foundation of the installation station; and after the final joint of the immersed tunnel is installed in Step VI, a grouting region around the final joint of the immersed tunnel is grouted through a preset grouting tube.

Compared with the prior art, the present application has beneficial effects as follows:

1. According to the final joint of the immersed tunnel of the present application, the two end surfaces of the final joint are set as the tilted surfaces, so that the whole final joint is of the inverted trapezoid structure; and therefore, during immersed installation of a final tube head, its position and posture may be controlled conveniently, a risk of collision with the to-be-connected installed adjacent tube sections is lowered, and the final tube head enters the installation station conveniently. The tilted surfaces formed by the final joint may be connected with the installed adjacent tube sections in a matched manner to realize final installation construction. The final joint of the immersed tunnel is simple in structure, convenient to install and control and relatively high in precision. During installation, lots of open sea diving work may be further reduced, and the risk of installation quality defects is lowered;

2. According to the final joint of the immersed tunnel of the present application, the inverted trapezoid structure may be further formed by the tube section I and the tube section II, so that during immersed installation of the final tube head, its position and posture may be controlled conveniently, the risk of collision with the to-be-connected installed adjacent tube sections is lowered, and the final tube head enters the installation station conveniently. The tilted surfaces formed by the tube section I and the tube section II are matched with the installed adjacent tube sections, and then connection and installation construction is completed. The final joint formed by connecting the two tube sections is convenient to machine, and the space between the tube sections is further formed after subsequent assembly of the two tube sections, thereby facilitating subsequent installation construction of the seal doors;

3. According to the final joint of the immersed tunnel of the present application, the push devices are used for enabling the Gina water stop bands to be in contact with the surfaces of the installed adjacent tube sections and to realize water stop between the combination cavities and the outside after the Gina water stop bands are fully compressed during connection of the tube section I as well as the tube section II and the corresponding installed adjacent tube sections, thereby facilitating later water drainage of the combination cavities and forming the dry construction environment;

4. According to the final joint of the immersed tunnel of the present application, the tube section I or/and the tube section II adopts the shell body, and the transverse diaphragms and the longitudinal diaphragms which are disposed in the shell body divide the shell body into the plurality of closed compartments; then the concrete is poured into the compartments to form the shell body concrete composite structure which may meet the requirement for the rigid connection strength of the tube section I or/and the tube section II and the installed adjacent tube sections; in addition, the plurality of L-shaped steel stiffening ribs are disposed on the connection surface of the tube section I or/and the tube section II, and the shear force transmission L-shaped steel stiffening ribs are distributed according to certain spacing; the transverse stiffening plates are also disposed longitudinally at certain spacing, thereby preventing slippage between steel plates and a concrete interface to guarantee common deformations of the shell bodies and the filled concrete.

5. According to the prefabrication method of the final joint of the immersed tunnel of the present application, prefabrication of a final structure of the immersed tunnel is realized by prefabricating the final joint shell body, arranging the plurality of transverse diaphragms and longitudinal diaphragms to form the plurality of compartments, then tensioning and compressing the prestressed tendons of the final joint, and finally pouring the concrete and installing the water stop systems; the prefabrication procedures of the final joint of the immersed tunnel are simple; and the final joint may be prefabricated in the land factory and then transported to the site, thereby reducing the influence of the weather conditions on construction, also lowering the quality risk, and improving the prefabrication efficiency of the final structure of the immersed tunnel.

6. According to the installation method of the final joint of the immersed tunnel of the present application, the body structure of the final joint is prefabricated in the factory, and the water stop systems are also installed in the factory; then the overall final joint is transported to the site for installation through the large-sized floating crane; and the water stop systems realize quick water stop to form the dry construction environment, thereby reducing the influence of the weather and tidal current conditions on the project, and also shortening the project construction period and lowering the quality risk.

1 for final joint; 101 for tube section I; 102 for tube section II; 2 for installed adjacent tube section; 3 for water stop structural member; 4 for shear key; 5 for water stop system; 6 for end seal door; 7 for gravel foundation bed; 8 for post-grouting region; 9 for shell body concrete composite structure; 10 for longitudinal diaphragm; 11 for L-shaped steel stiffening rib; 12 for hoisting point; 13 for side wall vertical steel shear key; 14 for middle wall vertical steel shear key; 15 for horizontal shear key; 16 for seamless steel pipe; 17 for anchor head; 18 for jack; 19 for pushing joist; 20 for joist sliding block; 21 for water stop band; 22 for M-shaped water stop band; 23 for measurement tower; 24 for guide adjustment system; 25 for guide frame.

DETAILED DESCRIPTION OF THE INVENTION

A further detailed description is made to the present application in combination with embodiments and specific implementation modes below, but it should not understand that the scope of the subject of the present application is merely limited by the embodiments below, and all those technologies implemented based on contents of the present application shall fall within the scope of the present application.

Embodiment 1

As shown in Figures from 1 to 4, a final joint 1 of an immersed tunnel includes a tube section I 101 and a tube section II 102 which are connected with each other. Connection surfaces, which are respectively connected with installed adjacent tube sections 2, of the tube section I 101 and the tube section II 102 are tilted surfaces, so that the tube section I 101 and the tube section II 102 jointly form an inverted trapezoid structure on the longitudinal profile along an installation direction; and water stop systems 5 connected with the installed adjacent tube sections 2 are disposed on the connection surfaces of the tube section I 101 and the tube section II 102.

Figure 2:
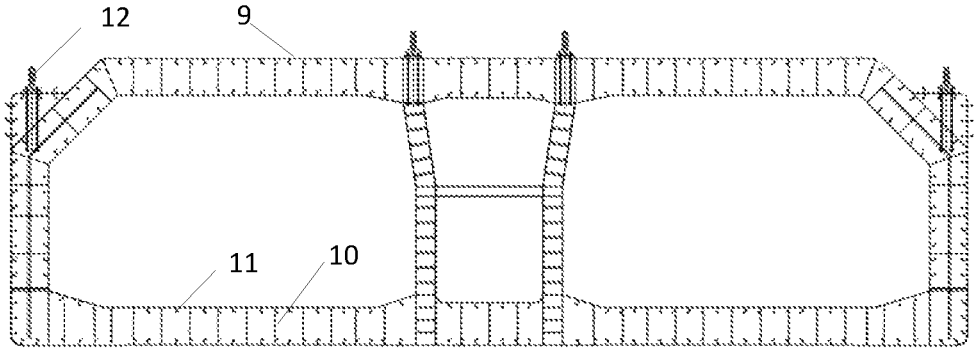
FIG. 2 is a diagram of a cross section of a body structure of a final joint of an immersed tunnel.

As shown in FIG. 2, the tube section I 101 and the tube section II 102 adopt shell bodies. A plurality of transverse diaphragms and longitudinal diaphragms 10 are disposed in the shell bodies; all the transverse diaphragms and longitudinal diaphragms 10 divide the shell bodies of the tube section 1101 and the tube section II 102 into a plurality of closed compartments; and each compartment is filled with concrete, and has concrete pouring holes and exhaust holes. The tube section I 101 and the tube section II 102 adopt the shell bodies, and the transverse diaphragms and the longitudinal diaphragms 10 are disposed in the shell bodies and divide the shell bodies into the plurality of closed compartments; and then concrete is poured into the compartments to form a shell body concrete composite structure 9 which may meet the requirement for the rigid connection strength of the tube section I 101 as well as the tube section II 102 and the installed adjacent tube section 2.

In addition, a plurality of L-shaped steel stiffening ribs 11 are disposed on the connection surfaces of the tube section I 101 and the tube section II 102, and the shear force transmission L-shaped steel stiffening ribs 11 are distributed according to certain spacing, and transverse stiffening plates are also disposed longitudinally at certain spacing; and in addition, the cross section of the final joint 1 is designed in consideration of the distribution of hoisting points 12 in a construction process, thereby preventing slippage between steel plates and a concrete interface to guarantee common deformations of the shell bodies and the filled concrete.

The tube section I 101 and the tube section II 102 are both of hollow structures, and end seal doors 6 are disposed in their inner cavities to prevent the water from entering the tube section I 101 and the tube section II 102 during tube immersion and avoid the influence on subsequent connection construction.

Figure 3:
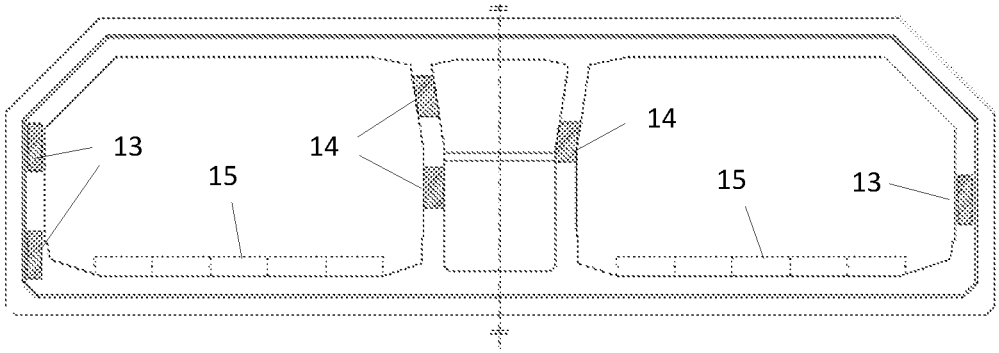
FIG. 3 is a schematic diagram of positions of shear keys of a final joint of an immersed tunnel.

As shown in FIG. 3, the tube section I 101 and the tube section II 102 are connected through water stop bands and a plurality of shear keys 4. Water stop structural members 3 are disposed at the peripheries of combination surfaces of the tube section I 101 and the tube section II 102 to enhance the connection strength of the tube section I 101 and the tube section II 102. The water stop structural members 3 are common rubber water stop bands.

Further, the shear keys are disposed between the tube section I 101 and the tube section II 102, wherein middle wall vertical steel shear keys 14 and side wall vertical steel shear keys 13 are disposed on the combination surfaces of the tube section I 101 and the tube section II 102. The middle wall vertical steel shear keys 14 are located at middle part isolation wall body positions of the combination surfaces of the tube section I 101 and the tube section II 102; the side wall vertical steel shear keys 13 are located at side wall isolation wall body positions on two sides of the combination surfaces of the tube section I 101 and the tube section II 102; for all the middle wall vertical steel shear keys 14 and all the side wall vertical steel shear keys 13, one part of each structure is located in a corresponding groove position on the combination surface of the tube section I 101, and the other part of the structure is located in a corresponding groove position on the combination surface of the tube section II 102; more than one middle wall vertical steel shear key 14 and more than one side wall vertical steel shear key 13 are included; in addition, for horizontal shear keys 15, one part of each structure is connected to the inner wall of a channel of the tube section I 101, and the other part of the structure is connected to the inner wall of a channel of the tube section II 102; and the quantity of the horizontal shear keys 15 is equal to that of the mutually corresponding channels in the tube section I and the tube section II. The middle wall vertical steel shear keys 14 and the side wall vertical steel shear keys 13 have effects of preventing the combination surfaces of the tube section I 101 and the tube section II 102 from mutually sliding and moving up and down, and the horizontal shear keys 15 have an effect of preventing mutual longitudinal separation of the tube section I 101 and the tube section II 102.

Figure 1:
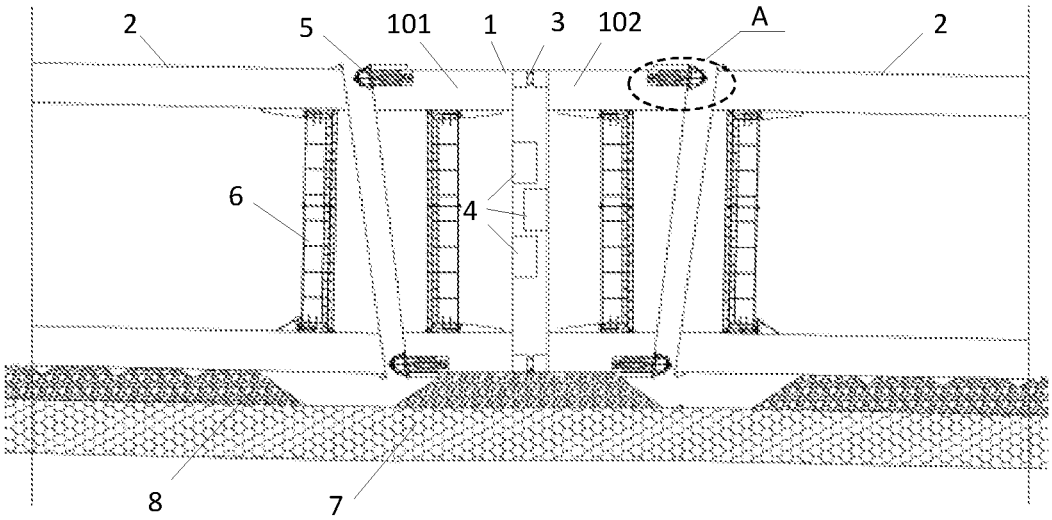
FIG. 1 is a schematic diagram of a vertical face of a final joint of an immersed tunnel of the present application.

For the purpose of facilitating prefabrication machining, the tube section I 101 and the tube section II 102 are of mutually symmetric right trapezoid structures. Further, the connection surfaces, which are respectively connected with the installed adjacent tube sections 2, of the tube section I 101 and the tube section II 102 form included angles of 5 to 15 degrees with the normal direction of an immersed tunnel installation surface, that is the immersed tunnel installation surface as shown in FIG. 1 is an installation horizontal plane.

Figure 4:
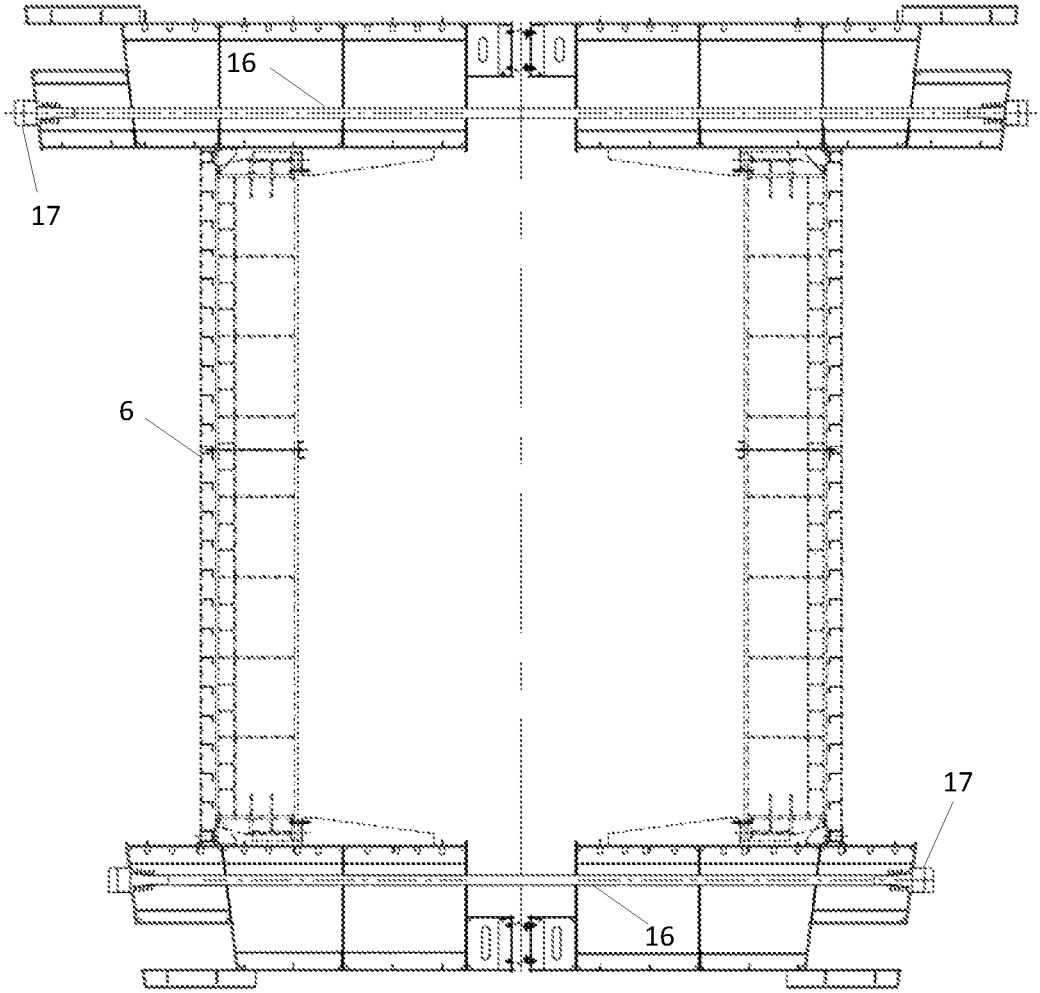
FIG. 4 is a diagram of prestress distribution of a final joint of an immersed tunnel.

As shown in FIG. 4, the tube section 1101 and the tube section II 102 are longitudinally equipped with at least two backup pipelines penetrating through the two tube sections. The backup pipelines are equipped with prestressed tendons for realizing tighter fitting between the combination surfaces of the tube section I 101 and the tube section II 102, thereby the two tube sections are mutually compressed under the action of the prestressed tendons to be fixed more firmly. Two backup pipelines penetrating through the two tube sections are disposed at each of the top and the bottom of each of the tube section I 101 and the tube section II 102. Prestressed tendons are disposed in each backup pipeline, and anchor heads 17 are disposed at the end portions of the backup pipeline.

Figure 5:
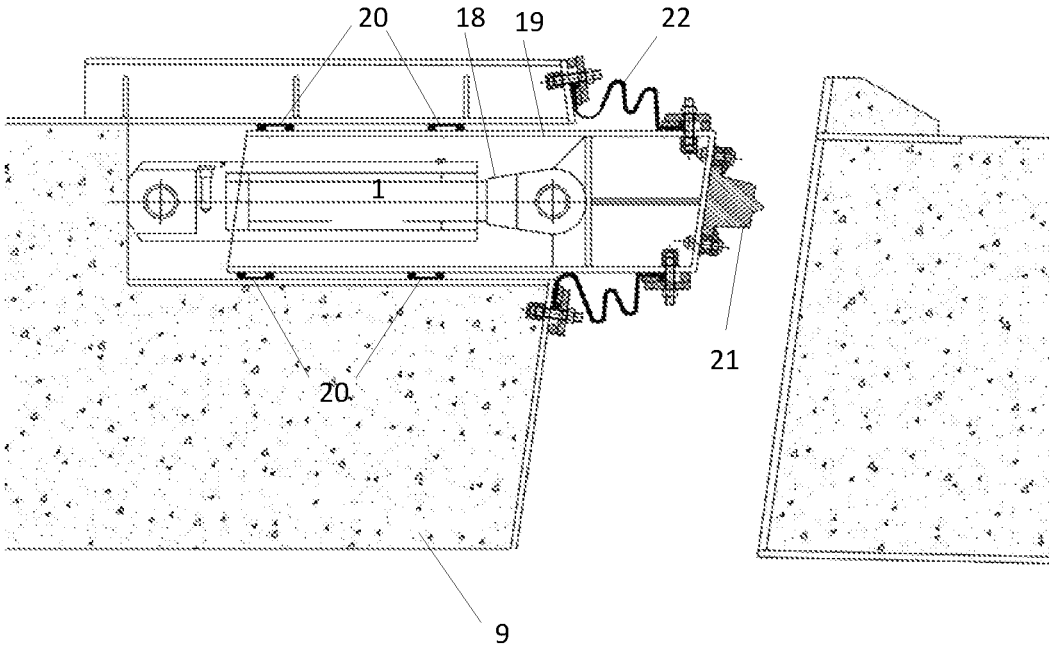
FIG. 5 is an enlarged view of a portion A in FIG. 1 in detail.
Figure 6:
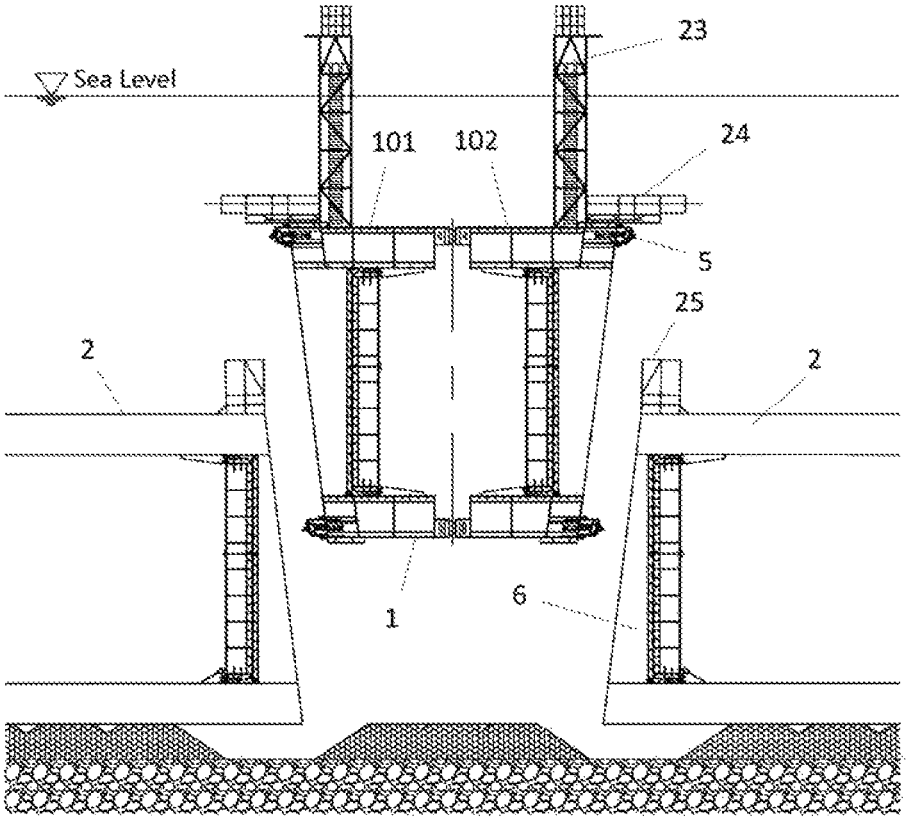
FIG. 6 is a schematic diagram of installation of a final joint of an immersed tunnel.

As shown in FIG. 5, the water stop systems 5 include push devices disposed on the connection surfaces of the tube section I 101 and the tube section II 102. A circle of Gina water stop band 21 is arranged outside each push device. To be more specific, the push devices include jacks 18 disposed on the connection surfaces of the tube section I 101 and the tube section II 102. Piston rods of the jacks 18 are connected with pushing joists 19 which are respectively connected to the connection surfaces of the tube section 1101 and the tube section II 102 through joist sliding blocks 20. The push devices are used for enabling the Gina water stop bands 21 to be in contact with the surfaces of the installed adjacent tube sections 2 and to realize water stop between the combination cavities and the outside after the Gina water stop bands 21 are fully compressed during connection of the tube section I 101 as well as the tube section II 102 and the corresponding installed adjacent tube sections 2, thereby facilitating later water drainage of the combination cavities and forming a dry construction environment Actually, a plurality of cavities are formed in the peripheries of the tube section I 101 and the tube section II 102. Each jack 18 and each pushing joist 19 are disposed in each cavity. The distribution spacing and the quantity of the jacks 18 and the strokes, the installation lengths and the sizes of jacking force of the jacks 18 are determined via stress calculation. Further, the end portion of each pushing joist 19 is parallel to the connection surfaces of the tube section I 101 and the tube section II 102, and the Gina water stop bands 21 are perpendicularly disposed on the end surfaces of the pushing joists 19. GINA water stop bands 2121 at the front ends of the joists are made of natural rubber, and are fixed on the tilted surfaces at the end portions of the joists through pressing member systems, and the water stop bands and the pressing member systems are perpendicular to the tilted surfaces at the end portions of the joists. One circle of water stop band is disposed along the tilted surface of the end portion of each joist, and is transitioned at a corner according to an arc with a fixed radius, and the circle center and the tilted surface at the end portion of the joist are coplanar; pressing plates and pressing strips should adopt anticorrosion coatings; aramid fiber reinforcing objects are added into the tip portions of the water stop bands to enhance the strength. The pressing member systems include the pressing plates, the pressing strips, hexagon socket cap screws and spring washers. The pressing plates and the pressing strips should adopt the anticorrosion coatings; the aramid fiber reinforcing objects are added into the tip portions of the water stop structural members 3 to enhance the strength.

In addition, M-shaped water stop bands 22 are further disposed between the pushing joists 19 and the tube sections I 101 and II 102, and are used for sealing cavity gap to sea paths. Made of butadiene styrene rubber, the M-shaped water stop bands 22 have certain deformability under a condition of a pressure greater than a specific water pressure. The M-shaped water stop bands 22 are fixedly connected to the pushing joists 19 through the pressing member systems including the pressing plates, the pressing strips, the screws and the spring washers which are connected with the two end portions of the M-shaped water stop bands 22.

According to the final joint 1 of the immersed tunnel of the present application, the inverted trapezoid structure is formed by the tube section 1101 and the tube section II 102, so that during immersed installation of a final tube head, its position and posture may be controlled conveniently, a risk of collision with the to-be-connected installed adjacent tube sections 2 is lowered, and the final tube head enters the installation station conveniently. The tilted surfaces formed by the tube section I 101 and the tube section II 102 are matched with the installed adjacent tube sections 2, and then connection and installation construction of the two tube sections is completed through the water stop systems 5, wherein the target of the water stop systems 5 is to realize a closed dry environment between the final joint 1 and the installed adjacent tube sections 2 and weld the joint in this environment.

The final joint 1 of the immersed tunnel is simple in structure, convenient to install and control and relatively high in precision. During installation, lots of open sea diving work may be further reduced, and a risk of installation quality defects is lowered.

Embodiment 2

The present application further provides a prefabrication method of a final joint 1 of an immersed tunnel, including:

Step I, respectively forming a shell body of a tube section I 101 and a shell body of a tube section II 102 according to shapes of the tube section I 101 and the tube section II 102;

Step II, installing a plurality of transverse diaphragm and longitudinal diaphragms 10 in the shell body of the tube section I 101 and the shell body of the tube section II 102 to form a plurality of compartments, and forming pouring holes and exhaust holes in each compartment;

Step III, connecting the shell body of the tube section I 101 with the shell body of the tube section II 102, and performing tensioning and compression through prestressed tendons, wherein multiple bundles of steel strands are disposed at each of a top plate and a bottom plate of the final joint 1, two backup pipelines are respectively reserved on each of the top plate and the bottom plate, and prestressed tendon pipelines are structurally seamless steel tubes 16;

Step IV, performing pouring: respectively pouring concrete through the pouring holes in the shell body of the tube section I 101 and the shell body of the tube section II 102, thus forming the tube section I 101 and the tube section II 102, wherein the final joint 1 is poured by a high-flow concrete pumping process in a factory, and self-leveling and vibration-free concrete is available in the pouring process; the adoption of a sectional pouring method reduces influence of concrete shrinkage and internalization heat on the structure to the maximum extent; and each compartment has a proper number of pouring holes and exhaust holes with proper diameters, thereby guaranteeing the overall pouring compactness.

Step V, installing water stop systems 5 on the connection surfaces, which are respectively connected with installed adjacent tube sections 2, of the shell body of the tube section I 101 and the tube section II 102, thus completing prefabrication of the final joint 1 of the immersed tunnel.

Further, the way of connecting the shell body of the tube section I 101 with the shell body of the tube section II 102 in Step III is realized through horizontal shear keys, middle wall vertical steel shear keys and side wall vertical steel shear keys which are disposed on the combination surface of the tube section I 101 or the tube section II 102.

In addition, within 48 hours after the tensioning is carried out through the prestressed tendons in Step III, vacuum pressure grouting is carried out in the prestressed tendon pipeline, and two ends of the prestressed tendon pipeline are anchored at the same time.

According to the prefabrication method of the final joint 1 of the immersed tunnel, prefabrication of a final structure of the immersed tunnel is realized by prefabricating the shell body of the tube section I 101 and the shell body of the tube section II 102, arranging the plurality of transverse diaphragms and longitudinal diaphragms 10 to form the plurality of compartments, then connecting the two tube sections, tensioning and compressing the tube sections through the prestressed tendons, and finally pouring the concrete and installing the water stop systems 5; prefabrication procedures of the final joint 1 of the immersed tunnel are simple; and the final joint may be prefabricated in a land factory and then transported to the site, thereby reducing influence of weather conditions on construction, also lowering a quality risk, and improving the prefabrication efficiency of the final structure of the immersed tunnel.

Embodiment 3

The present application further provides an installation method of a final joint 1 of an immersed tunnel, including:

Step I, prefabricating a tube section 1101 and a tube section II 102, and forming the final joint 1 of the immersed tunnel by adopting the above-mentioned prefabrication method of the final joint 1 of the immersed tunnel in Embodiment 2;

Step II, arranging tilted to-be-installed surfaces on two installed adjacent tube sections 2 to be connected with the tube section I 101 and the tube section II 102, respectively matching the two to-be-installed surfaces with connection surfaces of the tube section I 101 and the tube section II 102 in shape, and respectively installing end seal doors 6 in the tube section I 101, the tube section II 102 and the two installed adjacent tube sections 2, wherein outfitting work of the final joint 1 mainly includes in-tube outfitting members and tube-top outfitting members; the tube-top outfitting members mainly include guide systems 24, cable stranding systems, measurement towers 23, long manholes and the like; the in-tube outfitting members include grouting, detection and installation auxiliary equipment; and the in-tube outfitting members and the tube-top outfitting members are also assembled with a tower crane in a prefabrication factory;

Step III, towing the final joint 1 of the immersed tunnel to a position above an installation station, then immersing the final joint 1, and adjusting its posture to enable it to be aligned with the installation station between the two installed adjacent tube sections 2;

Step IV, respectively switching on water stop systems 5 on the tube section I 101 and the tube section II 102, wherein the two water stop systems 5 are respectively in contact with the to-be-installed surfaces of the two installed adjacent tube sections 2 to respectively form two combination cavities;

Step V, draining water from each combination cavity, thus forming a dry working environment;

Step VI, temporarily locking the tube section I 101 and the tube section II 102 on the corresponding installed adjacent tube sections 2 respectively, removing the end seal doors 6, and respectively welding the connection surfaces of the tube section I 101 and the tube section II 102 onto the corresponding installed adjacent tube sections 2;

Step VII, relieving prestress in the tube section I 101 and the tube section II 102, grouting a prestressed tendon pipeline, and finally completing installation of the final joint 1 of the immersed tunnel.

Further, the end seal doors 6 are disposed in the two installed adjacent tube sections 2 in Step II, and then are removed after Step V is completed. In addition, the measurement towers 23, the long manholes, the guide adjustment systems 24, hoisting facilities and the like are disposed at the tops of the tube section I 101 and the tube section II 102, and relevant equipment such as grouting facilities are disposed in the tube section I 101 and the tube section II 102; the temporary water stop systems 5 are disposed at combination portions; and guide frames 25 are correspondingly disposed at the tops of the installed adjacent tube sections 2.

Further, before the final joint 1 of the immersed tunnel is immersed in Step III, a gravel foundation bed 7 is pre-paved on a bottom foundation of the installation station; and after the final joint 1 of the immersed tunnel is installed in Step VI, a grouting region around the final joint 1 of the immersed tunnel is grouted through a preset grouting tube, wherein during construction, the end seal doors 6 are disposed in the installed adjacent tube sections 2 and the final joint 1; the gravel foundation bed 7 is pre-paved on the bottom foundation of the installed adjacent tube sections 2 and the final joint 1; the pre-paved gravel foundation bed 7 is of a structure with alternating ridges and furrows; after the final joint 1 is immersed and is rigidly connected with the installed adjacent tube sections 2, before in-tube ballasting construction, the preset grouting tube of the bottom plate is used to carry out post-grouting in a post-grouting region 8 to enhance a foundation support of this region.

According to the installation method of the final joint 1 of the immersed tunnel, a body structure of the final joint 1 is prefabricated in a factory, wherein the water stop systems 5 are also installed in the factory; then the overall final joint is transported to the site for installation through a large-sized floating crane; and the water stop systems 5 realize quick water stop to form the dry construction environment, thereby reducing influence of weather and tidal current conditions on a project, and also shortening the project construction period and lowering a quality risk.

The above contents are only preferred implementation modes of the present application. It should be noted that a person skilled in the art can make a plurality of improvements and replacements without departing from the technology principle of the present application, and these improvements and replacements shall be regarded as the scope of protection of the present application.

The invention claimed is:

1. A final joint of an immersed tunnel, comprising:

two end surfaces connected with installed adjacent tube sections;

a tube section I and a tube section II connected with each other; and water stop structural members and a plurality of shear keys connecting the tube section I and the tube section II, wherein:

the two end surfaces are both tilted surfaces, and connection surfaces of the tube section I and the tube section II are tilted surfaces respectively connected with the installed adjacent tube sections, so that the longitudinal profile of the final joint jointly formed by the tube section I and the tube section II along an installation direction is of an inverted trapezoid structure, and the water stop structural members are at peripheries of combination surfaces of the tube section I and the tube section II.

2. The final joint of the immersed tunnel according to claim 1, wherein the shear keys comprise middle wall vertical steel shear keys at a middle part of the combination surfaces of the tube section I or the tube section II, side wall vertical steel shear keys on two sides of the combination surfaces, and horizontal shear keys connected between inner walls of the tube section I and the tube section.

3. The final joint of the immersed tunnel according to claim 1, wherein structures of the tube section I and the tube section II are identical, and longitudinal profiles are both of right trapezoid structures.

4. The final joint of the immersed tunnel according to claim 1, wherein an inclination angle between the tilted surface of the tube section I or/and the tube section II and a vertical direction is 5 to 15 degrees.

5. The final joint of the immersed tunnel according to claim 1, further comprising water stop systems on the end surfaces connected with the installed adjacent tube sections.

6. The final joint of the immersed tunnel according to claim 5, wherein the water stop systems are also on the end surfaces of the tube section I and the tube section II; the water stop systems comprise push devices on the connection surface of the tube section I or/and the tube section II; and the final joint of the immersed tunnel further comprises a circular water stop band outside each push device.

7. The final joint of the immersed tunnel according to claim 6, wherein the push devices comprise jacks on the connection surfaces of the tube section I and the tube section II; and the jacks comprise piston rods, pushing joists and joist sliding blocks, wherein the piston rods are connected with the pushing joists, and the pushing joists are respectively connected to the connection surfaces of the tube section I and the tube section II through the joist sliding blocks.

8. The final joint of the immersed tunnel according to claim 6, wherein the tube section I and the tube section II include at least two backup pipelines that penetrate through the tube sections I and II along a longitudinal direction, and the backup pipelines include prestressed tendons.

9. The final joint of the immersed tunnel according to claim 8, wherein the at least two backup pipelines are at each of a top and a bottom of each of the tube section I and the tube section II; the prestressed tendons are in each backup pipeline, and the final joint of the immersed tunnel further comprises anchor heads at end portions of the backup pipelines.

10. The final joint of the immersed tunnel according to claim 8, wherein the tube section I and the tube section II are hollow, and the final joint of the immersed tunnel further comprises end seal doors in inner cavities of the tube section I and the tube section II.

11. The final joint of the immersed tunnel according to claim 10, wherein the tube section I or/and the tube section II comprise a metal shell body; the metal shell body comprises a plurality of transverse diaphragms and longitudinal diaphragms therein; the transverse diaphragms and longitudinal diaphragms divide the metal shell body into a plurality of closed compartments; and each closed compartment is filled with concrete, and has concrete pouring holes and exhaust holes.

12. The final joint of the immersed tunnel according to claim 11, further comprising a plurality of L-shaped steel stiffening ribs on the connection surface of the tube section I or/and the tube section II.

13. A final joint of an immersed tunnel, comprising:

two end surfaces connected with installed adjacent tube sections;

water stop systems on the end surfaces connected with the installed adjacent tube sections; and a tube section I and a tube section II connected with each other, wherein:

the two end surfaces are both tilted surfaces, connection surfaces of the tube section I and the tube section II are tilted surfaces respectively connected with the installed adjacent tube sections, so that the longitudinal profile of the final joint jointly formed by the tube section I and the tube section II along an installation direction has an inverted trapezoid structure, the water stop systems comprise push devices on the connection surface of the tube section I or/and the tube section II, the final joint of the immersed tunnel further comprises a circular water stop band outside each push device, and the push devices comprise jacks on the connection surfaces of the tube section I and the tube section II, and the jacks comprise piston rods, pushing joists and joist sliding blocks, wherein the piston rods are connected with the pushing joists, and the pushing joists are respectively connected to the connection surfaces of the tube section I and the tube section II through the joist sliding blocks.

14. The final joint of the immersed tunnel according to claim 13, wherein the tube section I and the tube section II are connected through water stop structural members and a plurality of shear keys; and the water stop structural members are at the peripheries of combination surfaces of the tube section I and the tube section II.

15. The final joint of the immersed tunnel according to claim 13, further comprising a plurality of cavities in peripheries of each of the tube section I and the tube section II; wherein each jack and each pushing joist is in a corresponding one of the cavities.

16. The final joint of the immersed tunnel according to claim 15, wherein an end portion of each pushing joist is parallel to the connection surfaces of the tube section I and the tube section II, and the water stop bands are perpendicular to the end surfaces of the pushing joists.

17. The final joint of the immersed tunnel according to claim 13, further comprising M-shaped water stop bands between the pushing joists and the tube sections I and II.

18. The final joint of the immersed tunnel according to claim 17, wherein the M-shaped water stop bands are fixedly connected to the pushing joists through pressing member systems comprising pressing plates, pressing strips, screws and spring washers connected with end portions of the M-shaped water stop bands.

19. The final joint of the immersed tunnel according to claim 13, wherein the tube section I and the tube section II are connected through water stop structural members and a plurality of shear keys; and the water stop structural members are at the peripheries of combination surfaces of the tube section I and the tube section II.

20. The final joint of the immersed tunnel according to claim 13, wherein structures of the tube section I and the tube section II are identical, and longitudinal profiles of both the tube section I and the tube section II are right trapezoids.

21. The final joint of the immersed tunnel according to claim 13, wherein the tilted surface of each of the tube section I and the tube section II has an inclination angle from 5 to 15 degrees with respect to a vertical direction.

22. A final joint of an immersed tunnel, comprising:

two end surfaces connected with installed adjacent tube sections;

a tube section I and a tube section II connected with each other;

water stop systems on the two end surfaces connected with the installed adjacent tube sections and on end surfaces of the tube section I and the tube section II, wherein:

the two end surfaces are both tilted surfaces connection surfaces of the tube section I and the tube section II are tilted surfaces respectively connected with the installed adjacent tube sections, so that the longitudinal profile of the final joint jointly formed by the tube section I and the tube section II along an installation direction has an inverted trapezoid structure, the water stop systems comprise (i) push devices on at least one of the connection surfaces of the tube section I and the tube section II and (ii) a circular water stop band outside each push device, the tube section I and the tube section II include at least two backup pipelines that penetrate through the tube sections I and II along a longitudinal direction, the backup pipelines include prestressed tendons, the tube section I and the tube section II are hollow and further include (i) inner cavities and (ii) end seal doors in the inner cavities, the tube section I and/or the tube section II comprise(s) a metal shell body and a plurality of transverse diaphragms and longitudinal diaphragms in the metal shell body, wherein the transverse diaphragms and longitudinal diaphragms divide the metal shell body into a plurality of closed compartments, and each closed compartment comprises concrete pouring holes and exhaust holes, and is filled with concrete.

23. The final joint of the immersed tunnel according to claim 22, wherein the tube section I and the tube section II are connected through water stop structural members and a plurality of shear keys; and the water stop structural members are at the peripheries of combination surfaces of the tube section I and the tube section II.

24. The final joint of the immersed tunnel according to claim 22, wherein structures of the tube section I and the tube section II are identical, and longitudinal profiles of both the tube section I and the tube section II are right trapezoids.

25. The final joint of the immersed tunnel according to claim 22, wherein the tilted surface of each of the tube section I and the tube section II has an inclination angle from 5 to 15 degrees with respect to a vertical direction.

26. The final joint of the immersed tunnel according to claim 22, further comprising a plurality of L-shaped steel stiffening ribs on the connection surfaces of the tube section I and the tube section II.

* * * * *